United States Patent [19]

Bianchi et al.

[11] Patent Number: 4,709,674

[45] Date of Patent: Dec. 1, 1987

[54] SYSTEM FOR AUTOMATICALLY CONTROLLING THE IDLING SPEED OF AN INTERNAL COMBUSTION ENGINE

[75] Inventors: Valerio Bianchi, Crespellano; Carlo Conticelli, Bologna, both of Italy

[73] Assignee: Weber S.p.A., Turin, Italy

[21] Appl. No.: 872,173

[22] Filed: Jun. 9, 1986

[30] Foreign Application Priority Data

Jun. 11, 1985 [IT] Italy ..... 67544 A/85

[51] Int. Cl.[4] ..... F02D 41/16

[52] U.S. Cl. ..... 123/339; 123/325; 123/327; 123/341

[58] Field of Search ..... 123/339, 340, 341, 352, 123/587, 585, 327, 325, 588, 320, 328

[56] References Cited

U.S. PATENT DOCUMENTS 4,237,833 12/1980 Des Lauriers ..... 123/339
4,237,838 12/1980 Kinugawa et al. ..... 123/339
4,305,360 12/1981 Meyer et al. ..... 123/339
4,462,360 7/1984 Kobayashi et al. ..... 123/339
4,563,989 1/1986 Peter ..... 123/339

FOREIGN PATENT DOCUMENTS 3246524 6/1984 Fed. Rep. of Germany ..... 123/339
58-167833 10/1983 Japan ..... 123/339

*Primary Examiner*—Andrew M. Dolinar
*Attorney, Agent, or Firm*—Gifford, Groh, VanOphem, Sheridan, Sprinkle and Dolgorukov

[57] ABSTRACT

A system for automatically controlling the idling speed of an internal combustion engine, comprising a valve, for supplying an adjustable quantity of additional air, and means for controlling the setting of the valve as a function of the detected speed of the engine and comparison with an idling speed range, and as a function of the detected pressure in the intake manifold and comparison with a value equivalent to the required air supply.

22 Claims, 7 Drawing Figures

SYSTEM FOR AUTOMATICALLY CONTROLLING THE IDLING SPEED OF AN INTERNAL COMBUSTION ENGINE

BACKGROUND OF THE INVENTION

The present invention relates to a system for automatically controlling the idling speed of an internal combustion engine, comprising a valve for supplying an adjustable quantity of additional air and generally set so as to choke a duct connecting zones up- and downstream from the throttle valve controlled by the accelerator.

On known automatic idling control systems, said valve consists of an electrovalve, the setting of which is controlled by a signal as a function of the difference between required and actually detected engine speed, for the purpose of maintaining engine speed constantly within a given range under varying operating conditions.

A major drawback on such known control systems is that they fail to provide for fast adjustment response, the disadvantage of which is particularly felt when applied to electronic injection systems providing for highly accurate, high-speed overall control of the engine via an electronic control system which, depending on signals from various sensors (mainly engine speed/-stroke and air intake pressure/temperature sensors), determines, for example, air density inside the manifold, and engine speed, and calculates, via interpolation on respective memorized maps, the stroke and timing for injecting fuel into the injectors, as well as the spark lead.

SUMMARY OF THE INVENTION

The aim of the present invention is to provide a system for automatically controlling the idling speed of an internal combustion engine, designed to overcome the aforementioned drawbacks, i.e. a system enabling automatic loop control with greatly improved adjustment speed, which is relatively straightforward in design and, more especially, may be readily applied to electronic injection systems with an electronic control system, and which adapts automatically to varying engine operating conditions.

Further aims and advantages of the automatic control system according to the present invention will be dealt with in the following description.

With this aim in view, according to the present invention, there is provided a system for automatically controlling the idling speed of an internal combustion engine, said system comprising a valve for supplying an adjustable quantity of additional air, characterized by the fact that it comprises means for controlling the setting of said valve as a function of the detected speed of said engine and comparison with a said idling speed range, and as a function of the detected pressure in the intake manifold and comparison with a value equivalent to the required air supply.

BRIEF DESCRIPTION OF THE DRAWINGS

One embodiment of the present invention will be described by way of example with reference to the accompanying drawings in which.

DETAILED DESCRIPTION OF THE INVENTION

Figure 1:
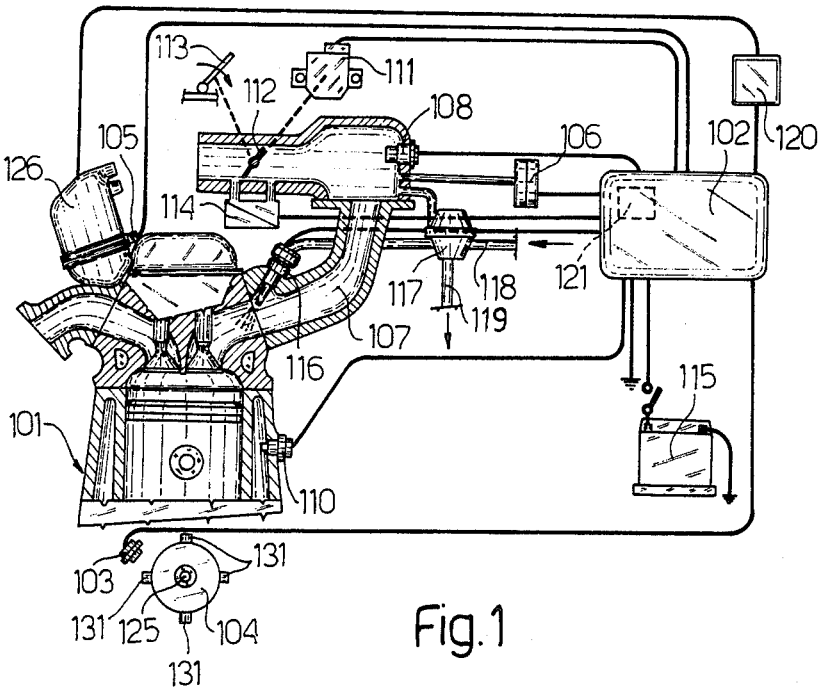
FIG. 1 shows a schematic view of an electronic injection system for an internal combustion engine with an automatic idling speed control system according to the present invention.

FIG. 1 shows, schematically, an electronic injection system for an internal combustion engine 101, conveniently a four-cylinder engine, shown partially and in cross section. The said system comprises an electronic control system 102 comprising, in substantially known manner, a microprocessor 121, registers containing memorised maps relative to various operating conditions of engine 101, and various counters and read and write memory (RAM) registers. The said control system 102 receives signals from:

- a sensor 103 for detecting the speed of engine 101 and located opposite a pulley 104 fitted on drive shaft 125 and having four equally spaced teeth 131;
- a sensor 105 for detecting the stroke of engine 101 and located inside a distributor 126;
- a sensor 106 for detecting the absolute pressure in intake manifold 107 on engine 101;
- a sensor 108 for detecting the air temperature inside manifold 107;
- a sensor 110 for detecting the water temperature inside the cooling jacket on engine 101;
- a sensor 111, consisting substantially of a potentiometer, for detecting the setting of a throttle valve 112 located inside intake manifold 107 and controlled by the pedal of an accelerator 113.

Between the portions of intake manifold 107 up- and downstream from throttle valve 112, there is connected a valve 114 for supplying additional air and the choke setting of which is controlled by system 102. In particular, said valve 114 may be an electromagnetic valve of the type described in Patent Application No. 3386-A/83 filed by the present Applicant on Apr. 12, 1983.

The said electronic control system 102 is connected to an electrical supply batters 115, and grounded, and, depending on the signals from the aforementioned sensors, engine speed and air density are employed for determining fuel supply according to the required mixture strength. The said control system 102 therefore controls the opening time of electroinjectors 116 located inside manifold 107 next to the intake valve of each respective cylinder, for controlling the amount of fuel supplied to the various cylinders on engine 101, and also controls injection timing for commencing fuel supply according to the strokes (intake, compression, expansion, exhaust) of engine 101. Each electroinjector 116 is supplied with fuel via a pressure regulator 117 sensitive to the pressure in intake manifold 107 and having a fuel intake duct 118 from a pump (not shown), and a return duct 119 to a tank (not shown). The said electronic control system 102 is also connected to a unit 120 controlling the ignition pulses supplied to the cylinders via distributor 126, and controls valve 114 for automatically controlling idling speed according to the characteristics of the present invention and as described in detail later on.

Figure 2:
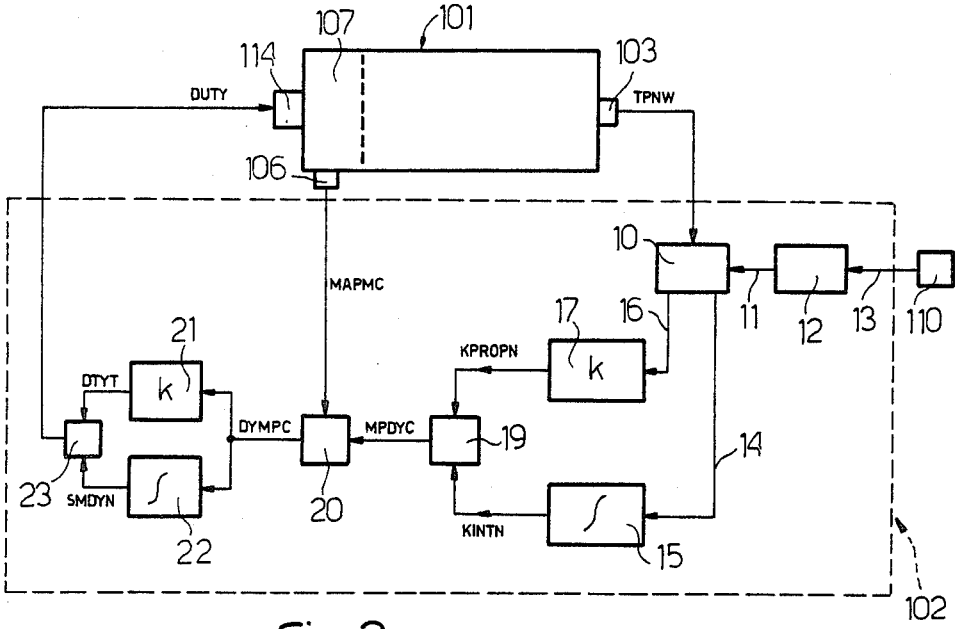
FIG. 2 shows a block diagram of the automatic control system according to the present invention.

FIG. 2 shows a block diagram of the automatic idling control system according to the present invention, which is functionally achieved by means of electronic control system 102. In more detail, FIG. 2 shows a processing and comparing block 10 which receives, from engine speed sensor 103, a first conveniently processed signal TPNW equal to the current engine stroke period, i.e. the period between the passage of two diametrically opposed teeth 131 on pulley 104 (FIG. 1) and indicating the real current speed of engine 101; and a second signal 11 indicating the required idling speed (preferably a given idling speed range) on engine 101, the said signal 11 being supplied by a processing block 12 controlled by a signal 13 as a function of the cooling water temperature on engine 101 as detected by sensor 110. Block 10 supplies a first output signal 14 which, via integrating block 15, supplies a first integral control parameter KINTN depending on engine cooling water temperature, developments in engine speed and the operating status of the engine itself. The said block 10 also supplies another signal 16 which, via proportional block 17, determines a second proportional control parameter KPROPN mainly depending on the speed of engine 101 and on a multiplication constant. The said two parameters supplied by blocks 15 and 17 are then added and processed in block 19, which supplies a signal MPDYC indicating a pressure equivalent to the required amount of air through valve 114. The said signal MPDYC is then compared, in block 20, with signal MAPMC indicating the pressure inside intake manifold 107 and supplied via sensor 106. The said signal MAPMC may be supplied and updated for each signal from engine speed sensor 103. Block 20 then supplies a signal DYMPC as a function of the difference between the pressure value equivalent to the required air supply, and the actual pressure inside intake manifold 107. Via a first proportional block 21, the said signal DYMPC supplies a third proportional control parameter DTYT, whereas, via a second integrating block 22, it supplies a fourth integral control parameter SMDYN substantially taking into account the variable operating efficiency of valve 114. The said third and fourth control parameters are processed in block 23 which supplies the DUTY time of a periodic electric signal, conveniently a square-wave signal with a frequency, for example, of 100 Hz, which controls electrovalve 114 so as to provide for mean choking of the duct connecting the zones up- and downstream from throttle valve 112.

Operation of the automatic idling control system according to the present invention will now be described in detail with reference to FIG. 3.

Figure 3A:
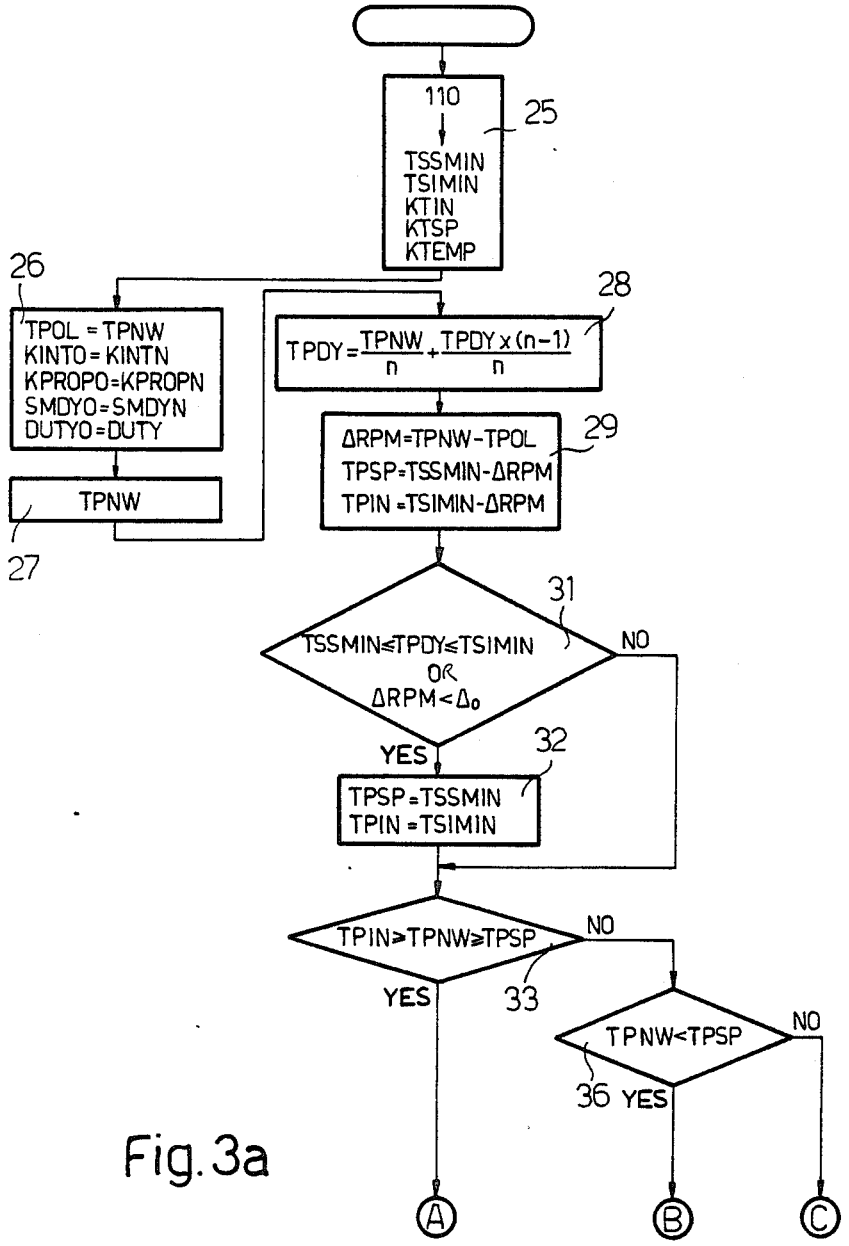
FIGS. 3*a, b, c, d* and *e* show operating block diagrams of the automatic control system according to the present invention.
Figure 3B:
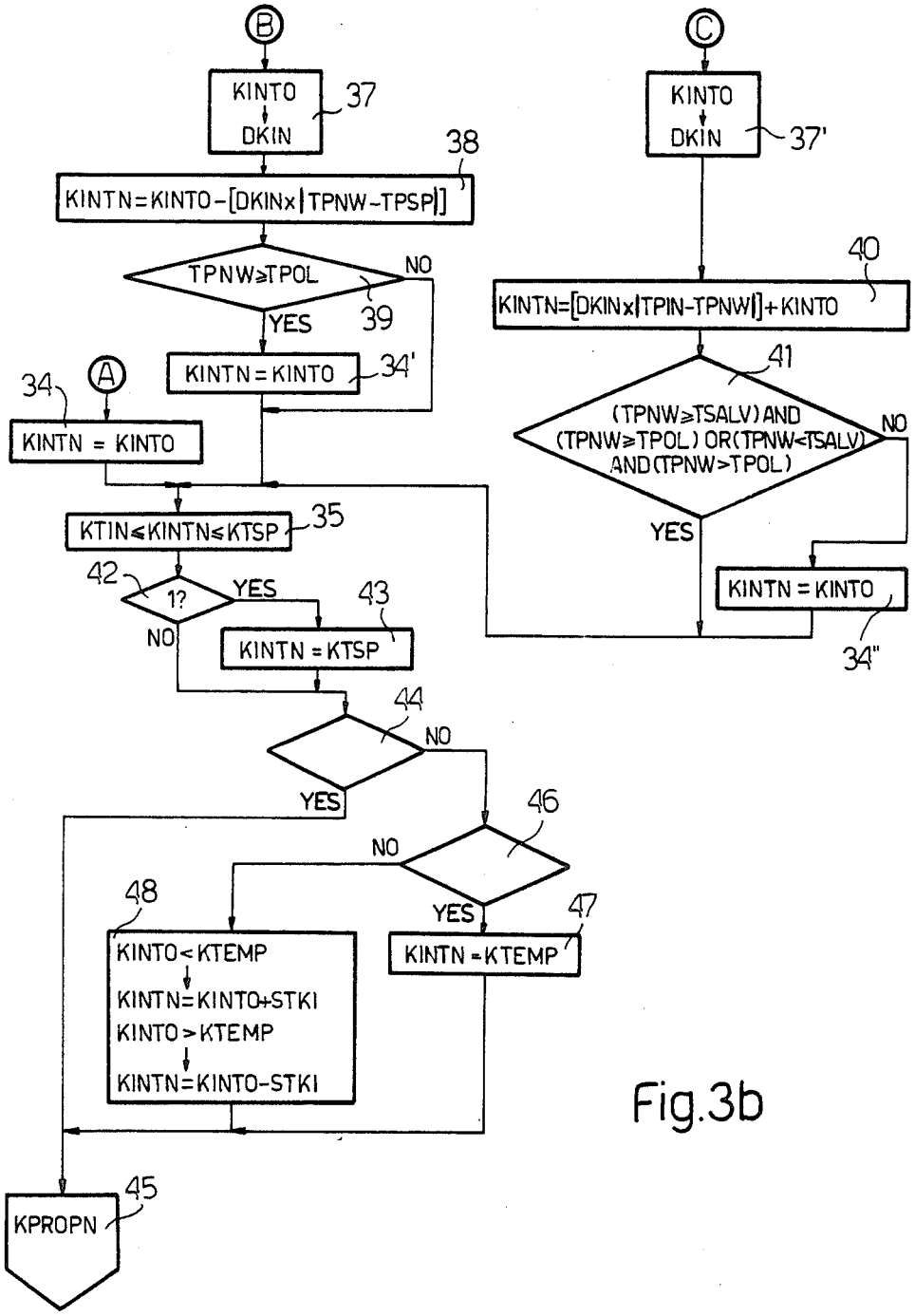

With reference to FIG. 3*a*, each repeat program performance by microprocessor 121 on control system 102 activates block 25 which, depending on the cooling water temperature of engine 101 as detected by sensor 110, controls selection on respective tables of sixteen values stored in ROM memories relative to: engine stroke period values (TSSMIN and TSIMIN) corresponding respectively to the upper and lower speeds in the static idling speed range within which adjustment parameters must be maintained unchanged by the control system; KTIN and KTSP values respectively defining the lower and upper limit values which may be assumed by the first integral control parameter (KINT) as defined with reference to FIG. 2; and, finally, a KTEMP value defining the initiation value of said KINT control parameter.

Block 25 goes on to block 26 which, in respective memory registers containing previously calculated parameter values, provides for updating the said parameters, in particular:

the engine stroke period value (TPNW) calculated in the foregoing cycle: TPOL=TPNW;

the values of the first and second control parameters calculated in the foregoing cycle: KINTO=KINTN and KPROPO=KPROPN;

the value of the fourth integral control parameter calculated in the foregoing cycle: SMDYO=SMDYN;

and, finally, the DUTY signal corresponding to the activation time of electrovalve 114: DUTYO=DUTY.

Block 26 goes on to block 27 which, by means of sensor 103, acquires a new value (TPNW) relative to the stroke period of engine 101. Block 27 then goes on to block 28 which works out the mean value (TPDY) of the last n strokes on engine 101: TPDY=(TPNW: n)+(TPDY×(n−1): n).

Block 28 goes on to block 29 the function of which is to calculate dynamic limits exceeding the static limits of said idling speed range, as a function of the deceleration rate of the engine. The said block 29 therefore calculates said deceleration rate as the period difference between two consecutive engine strokes, wherein, assuming deceleration, the subsequent stroke is of longer duration: ΔRPM=TPNW−TPOL. The upper dynamic limit of the non-intervention range therefore equals TPSP=TSSMIN−ΔRPM, and the lower dynamic limit TPIN=TSIMIN−ΔRPM. Downstream from block 29, the upper and lower non-intervention range limits employed for control are selected as a function of deceleration rate and engine speed in relation to said range, the static range limits only being employed if the mean stroke period corresponds to a speed already within said range, or if deceleration rate is below a given preset value. Block 29 therefore goes on to block 31 which determines whether: TSSMIN≦TPDY≦TSMIN, or whether ΔRPM is less than Δ. In the event of a positive response, block 31 goes on to block 32, which enters the static range limits (TPSP=TSSMIN and TPIN=TSIMIN), and then goes on to block 33. In the event of a negative response, block 31 goes directly to block 33, thus maintaining the dynamic range limits calculated in block 29.

Block 33 then determines whether the current stroke period (TPNW) is within the non-intervention range limits, i.e. whether TPIN≧TPNW≧TPSP. If it is, the value of the first control parameter must remain unchanged, therefore block 33 goes on to block 34, which enters KINTN=KINTO, and, from there, to block 35. If, on the other hand, the current stroke period is outside the non-intervention range limits, a new value must be calculated for the said first control parameter KINT. Block 33 therefore goes on to block 36 which determines whether the speed of engine 101 exceeds the upper control range limit, i.e. whether TPNW is less than TPSP. If it is, block 36 goes on to block 37 which, depending on the previously calculated value of the said first control parameter (KINTO), selects one of three DKIN coefficient values in a ROM memory. Block 37 then goes on to block 38 which therefore calculates the new value (KINTN) of said first parameter by subtracting from the former value (KINTO) said coefficient DKIN multiplied by the difference between engine speed and the upper control range limit: KINTN=KINTO−(DKIN×/TPNW−TPSP/). Block 38 then goes on to block 39 which determines that engine speed is not increasing, i.e. TPNW≧TPOL. In the event of a positive response (speed not increasing), the value of said first control parameter is left unchanged and block 39 goes on to block 34', similar to block 34, and, from there, to block 35. In the event, however, of a negative response (speed increasing), block 39 goes straight on to block 35, so that the new value of said first control parameter is the one calculated in block 38.

If, on the other hand, the response from block 36 is negative, i.e. engine speed below the lower control range limit, block 36 goes on to block 37' which, operating in the same way as block 37, goes on to block 40 which calculates a new value for said first control parameter by adding to the previous value said coefficient DKIN, determined in block 37', multiplied by the difference between current engine speed and the lower control range limit: KINTN=KINTO+(DKIN×/-TPIN−TPNW/). Block 40 goes on to block 41 which determines whether the speed of engine 101 is below a safety threshold speed defined by period TSALV and is either increasing or steady, or whether engine speed is above said safety threshold and decreasing. Block 41 therefore determines whether:

(TPNW≧TSALV) and (TPNW≧TPOL)

or

TPNW<TSALV) and (TPNW>TPOL).

In the event of a positive response, the new value of said first control parameter calculated in block 40 is retained and block 41 goes straight on to block 35. In the event of a negative response, the value of said first parameter calculated in the foregoing cycle is retained and block 41 goes on to block 34'' which, operating in the same way as block 34, goes on to block 35 which determines whether the value of said first control parameter (KINTN) to be applied falls within the lower and upper limits, that is, within KTIN and KTSP. In the event of a negative response, said value is limited to said maximum values. Block 35 then goes on to block 42 which determines whether the program performance is the first. In the event of a positive response, block 42 goes on to block 43 which sets the value of said first parameter KINTN to an initial value KTSP determined by block 25 as a function of the temperature detected by sensor 110, after which, block 43 goes on to block 44. In the event of a negative response in block 42 (i.e. prior programs having been performed), a value already exists for said first control parameter, in which case, block 42 goes straight on to block 44 which determines the simultaneous existence of three conditions:

- throttle valve 112 set to minimum (as detected by potentiometer 111), corresponding to accelerator 113 being fully released;
- the main control system on system 102 not set to so-called CUT OFF mode wherein fuel supply to electroinjectors 116 is cut off with accelerator 113 released, and as long as engine speed exceeds a given preset limit (conveniently a given speed range);
- completion of initial start-up of engine 101, as determined by a given engine stroke number count conveniently performed by means of a counter.

Figure 3C:
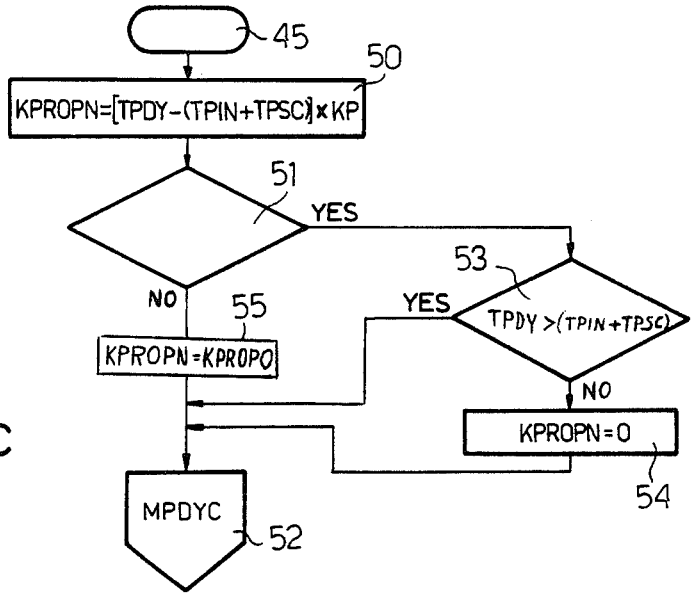
Figure 3D:
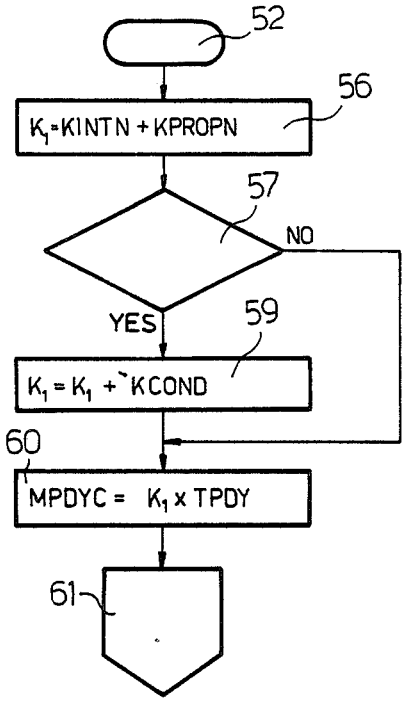
Figure 3E:
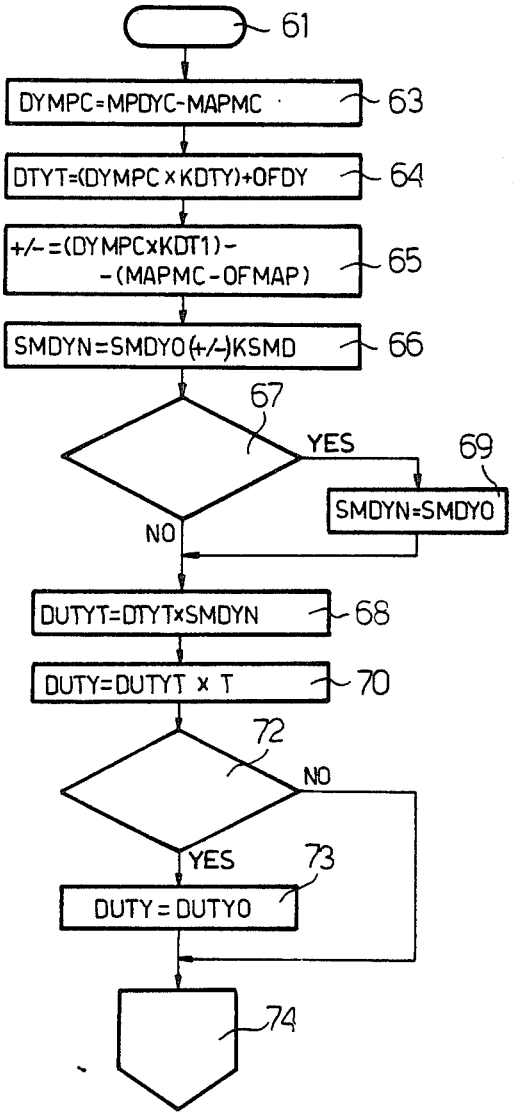

If such conditions exist, the value of said first control parameter KINTN calculated in the aforementioned blocks is retained and block 44 goes on to block 45 which, as described later on, controls the next program performance for calculating the second proportional control parameter (KPROPN). In the event of a negative response, however, from block 44, i.e. throttle valve 112 not set to minimum, or the main control system in CUT OFF mode, or engine 101 still being started up, instead of being determined by the aforementioned loop, the said first control parameter KINT is calculated substantially only as a function of the cooling water temperature on engine 101 as detected by sensor 110. Block 44 therefore goes on to block 46 which determines whether the system is in CUT OFF mode and whether the second control parameter (KPROP) is other than zero. In the event of a positive response, block 46 goes on to block 47 which enters value of the said first control parameter as equalling the KTEMP value determined by block 25 in FIG. 3*a*. In the event of a negative response, block 46 goes on to block 48 which adapts the value of said first parameter, starting from the previous value (KINTO) and in consecutive steps (STKI), towards said KTEMP value. Block 48 therefore determines whether KINTO<KTEMP, in which case, it enters KINTN=KINTO+STKI; whereas, if KINTO>KTEMP, it enters KINTN=KINTO−STKI. Block 48 then goes on to block 45 which, as shown in FIG. 3*c*, controls block 50 for calculating said second control parameter as a function of the mean speed of engine 101 and the deviation from the lower control range speed, decreased by a given constant, equal to period TPSC, for preventing control swing. Block 50 therefore enters KPROPN=(TPDY−(-TPIN+TPSC))×KP, in which KP is a proportionality constant. Block 50 then goes on to block 51 which determines the simultaneous existence of the following three conditions: (a) throttle valve 112 set to minimum; (b) main control system not in CUT OFF mode; (c) start-up engine 101 completed. In the event of a negative response, block 51 goes on to block 55 which leaves unchanged the value of said control parameter calculated in the foregoing cycle and goes on to block 52. In the event of a positive response, however, block 51 goes on to block 53 which determines whether the mean speed of the last n strokes in below the lower control range limit, less an additional (speed) quota, i.e. whether TPDY>TPIN+TPSC. In the event of a positive response, the value of the second calculated control parameter remains unchanged and block 53 goes on to block 52 which provides for calculating parameter MPDYC relative to the pressure equivalent to the required air supply through valve 114, as described in more detail later on. In the event of a negative response, however, block 53 goes on to block 54 which enters a second control parameter value of 0. Blocks 54 and 55 go on to block 52 which, as shown in FIG. 3*d*, controls block 56 for calculating a parameter $K_1$ equal to the sum of said first and second control parameters. Block 56 then goes on to block 57 which determines whether or not a vehicle passenger compartment air conditioning system is activated and powered by engine 101. In the event of a positive response, block 57 goes on to block 59 which adds a value KCOND to the value of parameter $K_1$ and then goes on to block 60. In the event of a negative response, however, in block 57 (air conditioner not activated), block 57 goes straight to block 60, in which case, parameter $K_1$ remains as calculated in block 56. Block 60 calculates said pressure equivalent to the required air supply through valve 114 by multiplying parameter $K_1$ by the mean stroke period of the last n strokes, i.e. MPDYC=$K_1$×TPDY, after which, it goes on to block 61 which compares said equivalent value (MPDYC) as calculated in block 60 with the pressure value (MAPMC) detected in intake manifold 107 by sensor 106, for calculating the DUTY CYCLE of electrovalve 114. As shown in FIG. 3*e*, block 61 controls a block 63 for calculating parameter DYMPC by subtracting from parameter MPDYC, as calculated in block 60, parameter MAPMC detected by sensor 106. Block 63 then goes on to block 64 which calculates the third proportional control parameter (DTYT) by multiplying the error signal (DYMPC) calculated in block 63 by a first constant KDTY and adding a second constant OFDY. Block 64 then goes on to a series of two blocks 65, 66 which, again as a function of said error value calculated in block 63, calculate the fourth integral control parameter (SMDY) which is substantially proportional to the efficiency of valve 114. In more detail, block 65 multiplies DYMPC by a first constant $KDT_1$, from the product of which is subtracted the difference between the MAPMC value supplied by sensor 106 and a constant value OFMAP. The sign determined by said subtraction is used in block 66 for accordingly changing the sign of, and altering by a constant amount KSMD, the value of said fourth control parameter calculated in the foregoing cycle (SMDYO). Block 66 then goes on to block 67 which checks that throttle valve 112 is not set to minimum, or that the main control system is in CUT OFF mode. In the event of a negative response, the value of said fourth control parameter calculated in block 66 is left unchanged and block 67 goes straight on to block 68. In the event of a positive response, the value of the said fourth control parameter is left as calculated in the foregoing cycle and block 67 goes on to block 69, which enters SMDYN=SMDYO and then goes on to block 68 which multiplies the third control parameter DTYT calculated in block 64 by said fourth control parameter SMDYN and supplies a parameter DUTYT indicating the duty time percentage of valve 114 in relation to the period of the periodic electric control signal. The said parameter DUTYT may conveniently range from 0 to 255, which correspond to DUTY CYCLE values of 0% and 100% respectively for controlling electrovalve 114. Block 68 goes on to block 70 which calculates the DUTY time of electrovalve 114 by multiplying said DUTYT value supplied by block 68 by a value T corresponding to the period of the periodic signal controlling electrovalve 114. In the case of a periodic signal of 100 Hz frequency, period T is 10 milliseconds and the DUTY valve is expressed in milliseconds. Block 70 goes on to block 72 which determines that throttle valve 112 is not set to minimum, and that the speed of engine 101 exceeds the upper CUT OFF range threshold. In the event of a positive response, block 72 goes on to block 73 which maintains the DUTY value as calculated in the foregoing cycle and goes on to block 74 which causes current to be supplied to the winding on electrovalve 114 for said DUTY time. In the event of a negative response, however, block 72 goes straight on to block 74 for enabling current supply for the time defined in block 70.

The advantages of the system for automatically controlling the idling speed of engine 101 according to the present invention will be clear from the foregoing description. In addition to the loop circit for comparing real speed, as detected by sensor 103, with required speed determined as a function of the operating status of the engine 101, the control according to the present invention also presents another internal loop control for controlling pressure signals relative to the real pressure detected by sensor 106, and the pressure equivalent to the required air supply (MPDYC) and calculated by the first part of the control circuit as a function of the difference between real and requiried engine speed. This provides for faster response of the control system, while at the same time maintaining sufficiently straightforward system design. In like manner, the idling speed of engine 101 is automatically maintained within a preset range, with automatic adaption of changing idling speed conditions caused, for example, by cold starting of the engine 101, in which case, engine speed is gradually restored according to the cooling water temperature detected by sensor 110, or caused by aging of the engine or varying load at idling speed. Furthermore, whereas changes in the control parameters are not always utilized, depending on the various operating conditions involved, they are nevertheless always calculated for enabling faster parameter adjustment when required. Furthermore, the choke setting of electrovalve 114 on the relative connecting duct is maintained even when throttle valve 112 is not set to minimum, thus enabling faster setting of electrovalve 114 as required upon activation of the automatic idling control system described herein.

To those skilled in the art it will be clear that changes may be made to the automatic control system as described herein without, however, departing from the scope of the present invention.

We claim:

1. A system for automatically controlling the idling speed of an internal combustion engine (101) within an idling speed range, said system comprising a valve (114) for supplying an adjustable quantity of additional air, characterized by the fact that it comprises means (102) for controlling the setting of said valve (114) as a function of a detected speed of said engine (101) and comparison of the detected engine speed with an idling speed range, and further as a function of a detected pressure in an intake manifold (107) and comparison of the detected intake manifold pressure with a value equivalent to the required air supply wherein said control means (102) comprises means (29) for detecting a deceleration rate of said engine (101) and for thereafter calculating dynamic limits which exceed preset static limits of said idling speed range, said control means further comprising means (31) for determining whether said deceleration rate is below a given threshold value, or whether a mean speed over a predetermined number of previous strokes on said engine (101) is within said static limits of said range, and, if either condition is true, for saving said static range limits for future calculations, and otherwise saving said dynamic limits for future calculations.

2. A system as defined in claim 1, characterized by the fact that, as a function of detected engine speed and comparison with the said range, said control means (102) determine a first integral control parameter (KINT) and a second proportional control parameter (KPROP), and that said first and second control parameters determine said pressure value (MPDYC) equivalent to the required air supply.

3. A system as claimed in claim 2, characterized by the fact that, as a function of the said pressure detected in the intake manifold (107) and comparison with said pressure value equivalent to the required air supply, said control means (102) determine a third proportional control parameter (DTYT) and a fourth integral control parameter (SMDY), and that said third and fourth control parameters determine a control (DUTY) for setting said valve (114).

4. A system as claimed in claim 1, characterized by the fact that said valve (114) is an electromagnetic valve, the setting of which is controlled by a periodic electric signal and the activation time of which is determined by said control means (102).

5. A system as claimed in claim 1, characterized by the fact that said control means (102) comprise means (25) for determining the upper and lower limit values of the said idling speed range as a function of the cooling water temperature on the engine.

6. A system as claimed in claim 2, characterized by the fact that said control means comprise means (33) for determining whether the speed of said engine is within the limits of said range, and which, in the event of a positive response, leave said first control parameter (KINT) unchanged, and, in the event of a negative response, determine, via further means (36), whether engine speed exceeds the upper limit in said range, and which, in the event of a positive response, maintain unchanged or calculate a new value for the said first parameter (KINT) as a function of the difference between said engine speed and said upper range limit, depending on whether said engine speed is not increasing or is increasing, and, in the event of a negative response, calculate a new value for said first parameter (KINT) as a function of the difference between said engine speed and the lower range limit, or maintain said parameter unchanged, depending on whether said engine speed is below a given safety threshold and either decreasing or steady, or over the said safety threshold and decreasing or not.

7. A system as claimed in claim 6, characterised by the fact that said control means (102) comprise means (35) for limiting the said first control parameter (KINT) to within given limit values.

8. A system as claimed in claim 7, characterized by the fact that said control means (102) comprise means (25) for determining said limit values for said first control parameter (KINT) as a function of the cooling water temperature on the engine (101).

9. A system as claimed in claim 7, characterized by the fact that said control means (102) comprise means (42, 43) for establishing the initial value of said first control parameter (KINT) equal to said upper limit value.

10. A system as claimed in claim 6, characterized by the fact that said control means (102) comprise means (44) for determining the existence of three conditions, namely whether the pedal of the accelerator (113) is released, whether fuel supply is not in a CUT OFF mode with the accelerator (113) released, and whether the initial start-up stage has been completed, said means (44) being designed, in the event that any of these three are true, to maintain the value of said first control parameter (KINT) unchanged, and, in the event that all three conditions are false said control means (102) comprising further means (46) for determining the existence of said CUT OFF mode or a value other than zero for said second control parameter (KPROP), and designed, in the event of a positive response, to establish for said first control parameter (KINT) a given base value depending on the temperature of the cooling water in the engine, and, in the event of a negative response, to establish for the first control parameter (KINT) a value depending on the value calculated in a previous cycle and varying progressively towards said given base value.

11. A system as claimed in claim 2, characterized by the fact that said control means (102) comprise means (50) for calculating the value of said second control parameter (KPROP) as a function of the difference between the mean speed over a predetermined number of previous strokes on said engine (101) and a reference speed corresponding to the lower limit of said range and decreased by a further value; and further means (51) for determining the simultaneous existence of conditions wherein the pedal of said accelerator (113) is released, fuel supply is not in a CUT OFF mode, and the initial start-up stage has been completed; which said further means (51), in the event of a negative response, maintain unchanged said calculated value of said second control parameter (KPROP), and, in the event of a positive response, go through further means (53) determining whether said mean engine speed is below said reference engine speed, and, in the event of a positive response, maintain unchanged said calculated value of said second control parameter (KPROP), and, in the event of a negative response, enter a said second control parameter (KPROP) value of zero.

12. A system as claimed in claim 2, characterized by the fact that said control means (102) comprise means (56) for obtaining a fifth control parameter ($K_1$) as a function of the values of said first (KINT) and second (KPROP) control parameters.

13. A system as claimed in claim 12, characterized by the fact that said control means (102) comprise means (57, 59) for adding to said fifth control parameter ($K_1$) a value (KCOND) depending on whether a vehicle passenger compartment air conditioning system is activated or not and powered by said engine (101).

14. A system as claimed in claim 12, characterized by the fact that said control means (102) comprise means (60) for multiplying said fifth control parameter (K) by a mean engine speed, and for obtaining said pressure value (MPDYC) equivalent to the required air supply.

15. A system as claimed in claim 3, characterized by the fact that said control means (102) comprise means (63) for obtaining a sixth control parameter (DYMPC) as a function of the difference between said pressure value equivalent to the required air supply and said pressure value detected in the intake manifold (107) of said engine.

16. A system as claimed in claim 15, characterized by the fact that said control means (102) comprise means (64) for obtaining said third control parameter (DTYT) as a function of said sixth control parameter (DYMPC).

17. A system as claimed in claim 15, characterized by the fact that said control means (102) comprise means (65, 66) for obtaining said fourth control parameter (SMDY) as a function of said sixth control parameter (DYMPC), and further means (67) for determining that the pedal of said accelerator (113) is not released or that fuel supply is in a CUT OFF mode, and which, in the event of a positive response, maintain unchanged the value of said fourth control parameter (SMDY).

18. A system as claimed in claim 15, characterized by the fact that said control means (102) comprise means (68) for obtaining a seventh control parameter (DUTYT) as a function of the values of said third (DTYT) and fourth (SMDY) control parameters, said seventh parameter (DUTYT) supplying a percentage value of the activation time of a periodic signal controlling said valve (114); and means (70) for multiplying said seventh control parameter (DUTYT) by said period (T) of said control signal, for obtaining said activation time (DUTY).

19. A system as claimed in claim 18, characterized by the fact that said control means (102) comprise means (72) for determining that the pedal of said accelerator (113) is not released and that the speed of said engine (101) exceeds a fuel CUT OFF upper threshold, said means (72), in the event of a positive response, maintaining unchanged said DUTY time of said valve (114).

20. A system as claimed in claim 1, characterized by the fact that said valve (114) is arranged so as to cut off communication between zones up-and downstream from a valve (112) controlled by the pedal of said accelerator (113).

21. A system as claimed in claim 1, characterized by the fact that said control means (102) comprise a microprocessor (121).

22. A system as claimed in claim 1, characterized by the fact that said engine is an electronic injection system.

* * * * *

UNITED STATES PATENT AND TRADEMARK OFFICE

CERTIFICATE OF CORRECTION

PATENT NO. : 4,709,674

DATED : December 1, 1987

INVENTOR(S) : Valerio Blanchi et al

It is certified that error appears in the above-identified patent and that said Letters Patent is hereby corrected as shown below:

Col. 2, line 42 delete "batters" and insert --battery--.

Col. 5, line 27, delete "TPNW" and insert --(TPNW--.

Col. 6, line 35 after "start-up" insert --of--;

line 41, delete "in" and insert --is--.

Col. 7, line 63, delete "circit" and insert --circuit--.

Col. 8, line 4, delete "requiried" and --required--;

lines 42-54, delete the indentation.

Col. 10, lines 25-30, delete the indentation.

Signed and Sealed this

Nineteenth Day of July, 1988

*Attest:*

DONALD J. QUIGG

*Attesting Officer*

*Commissioner of Patents and Trademarks*